US006416392B1

(12) United States Patent
Fitzgerald et al.

(10) Patent No.: US 6,416,392 B1
(45) Date of Patent: Jul. 9, 2002

(54) SOUND ENHANCED LAPPING PROCESS

(75) Inventors: Bettina M. Fitzgerald, Amboy; Karl O. Swanson; Debra L. Zinser, both of Vancouver, all of WA (US)

(73) Assignee: SEH America, Inc., Vancouver, WA (US)

( * ) Notice: Subject to any disclaimer, the term of this patent is extended or adjusted under 35 U.S.C. 154(b) by 0 days.

(21) Appl. No.: 09/727,827

(22) Filed: Nov. 30, 2000

(51) Int. Cl.[7] ..... B24B 1/00

(52) U.S. Cl. ..... 451/41; 451/283; 451/285; 451/287

(58) Field of Search ..... 451/41, 283, 285, 451/287

(56) References Cited

U.S. PATENT DOCUMENTS 5,857,893 A * 1/1999 Olsen et al.
5,865,666 A * 2/1999 Nagahara

* cited by examiner

*Primary Examiner*—Timothy V. Eley
*Assistant Examiner*—Willie Berry, Jr.
(74) *Attorney, Agent, or Firm*—Douglas G. Anderson

(57) ABSTRACT

A method of lapping semiconductor wafers includes the step of transmitting sounds generated during the lapping process to a receiver, allowing the operator to use sound to more quickly detect problems associated with starting the lap process.

4 Claims, 2 Drawing Sheets

SOUND ENHANCED LAPPING PROCESS

FIELD OF THE INVENTION

The present invention relates to an improved means and method of lapping thin wafer like materials, and more particularly to the use of sound transmission during the lapping process.

BACKGROUND OF THE INVENTION

The preparation of semiconductor devices made from silicon, gallium-arsenide, and the like, begins with growing a monocrystalline boule. The boule is then sliced into thin disks called wafers. The wafers are then circumferentially ground, lapped, chemically etched, polished, and cleaned.

The lapping step is conventionally carried out in large orbital lapping machines that are well known in the art.

In the lapping process, the wafers are positioned in circular plates called carriers. The carriers are designed with holes prepared in them that are slightly larger in diameter than the wafer to be lapped, and are slightly thinner than the target thickness of the wafers at the end of the lap cycle. The carriers are circular shaped, and usually have gear teeth around the outside periphery. The gear teeth interact with a center gear and an annular gear such that a drive motor turning the gears causes the carrier to rotate around the center gear and around itself in an orbital motion. The design of the carrier positions the wafer-containing holes toward the outer edge of the carrier such that they rotate around the center of the carrier itself during machine operation. By changing the gear ratios of the carriers, annular gear, and center gear, the rotational direction of the carriers can be controlled and changed as needed to control flatness and wear of lapping plates.

Both the carriers, and the wafers contained within them, are supported by a bottom lapping plate. Upon starting a lap cycle, a top lapping plate lowers onto the wafers under a controlled, and typically very light, pressure. A slurry containing an abrasive and other components such as a soap, rust inhibitor, or surfactant as desired, is introduced to the wafers through slurry supply holes in the top plate. One or both of the plates are typically linked to either the center gear or the annular gear such that they rotate in a controlled ratio and direction along with the center gear, annular gear, and carrier. The combined rotation of each of these items results in the wafers moving in a circular motion within the carrier, around the carrier, and around the center gear, with the top and bottom lapping plates rubbing against the two flat surfaces of the wafer. Wafers lapped in such a manner have very smooth and flat surfaces, with a high degree of uniformity between wafers lapped in the same cycle.

Following an operator-designated time, additional pressure is gradually exerted on the wafers from the top plate either from the weight of the top plate or from a mechanical means. The force exerted on the wafers, the motion of the wafers around the plates, and the abrasive in the slurry combine to lap away the surfaces of the wafer in small increments. When the desired thickness of the wafers is reached, the lap cycle is stopped, slurry delivery is stopped, and the top plate raises off the wafers. The wafers are then removed from the lap machine.

The lapping plates used for the process are typically metal, and have grooves cut into the surfaces that are in contact with the wafers. Among other functions, the grooves assist in supplying slurry to the entire surface of the wafers, carriers, and plates, and to facilitate the removal of the used slurry and residue of the lapped wafer. The grooves can be cut into the plates in many different patterns as the user desires. The grooves are typically about 5 millimeters wide, and initially about 15 millimeters deep. Over time however, the surfaces of the lapping plates are abraded away, and the grooves become much more shallow. As a result, the lapping plates either need to be replaced, or resurfaced with new grooves cut into the surfaces.

As the lap machine is used in repeated cycles, the grooves become clogged with the residue slurry and the material lapped from the wafers, plates, and carriers, inhibit removal of the waste slurry and become a trap for particles and contaminants. The grooves, when clogged, create a buildup of slurry on the bottom plate that causes the wafers to float during the start of the lap cycle. Wafers can then escape the confines of the wafer-containing holes of the carrier, and break in the lap machine. Wafer shards can then become lodged in the residue slurry in the grooves of the bottom plate and become projectiles that can scratch wafers lapped in future cycles.

Wafers processed in the lap machine typically have a beveled circumferential edge. As previously mentioned, the diameter of the wafer-containing holes in the carrier is only slightly larger than the diameter of the wafers being lapped. These conditions combined make it possible for the operator to improperly seat the wafer into the wafer-containing hole such that the beveled edge of the wafer rests on the edge of the carrier. In such an instance, when the top plate is lowered onto the improperly seated wafer, it will break. As previously indicated, a broken wafer in the machine causes significant damage to other wafers, as well as to the lap machine, and may result in extended machine downtime. Any scenario involving a broken wafer in a lap machine is referred to as a "crash".

To prevent a crash, the operator will listen very closely to the lap machine during the first minute or more of the lap cycle. Typically, when a machine is about to crash, a distinguishable chatter-noise is heard. When the operator hears that particular noise, the machine is immediately stopped and the wafers are re-seated in the wafer-containing holes. The lap cycle is then restarted.

In an effort to reduce production costs, semiconductor manufacturers are continually striving for larger diameter wafers. As the diameter of wafers increases, new and larger processing equipment must be designed and implemented. The design of late model lapping machines makes it very difficult for the operator to hear chatter-noise originating from the center or back of the machine. The newer designs also incorporate a plastic safety shield that encloses the front of the machine, which further inhibits the operator being able to detect a crash by hearing the chatter-noise.

Consequently, there is a need of an apparatus to assist in the early detection of chatter-noises symbolic of a lapping crash wherein wafers leave the confines of the wafer-containing holes in the carriers and break in the lapping machine.

SUMMARY OF THE INVENTION

The apparatus disclosed herein includes a sound transmitting device, such as a microphone, placed within the confines of the safety shield, and oriented in such a way as to capture and transmit sounds generated within the lapping machine. The apparatus also includes a receiver placed outside the confines of the safety shield in a location convenient for the operator that receives and broadcasts sounds generated within the lapping machine. The apparatus may include an amplifier to increase the power of the sound output in any or all frequency ranges such that an operator may selectively screen for particular sounds.

DETAILED DESCRIPTION OF THE INVENTION

Figure 1:
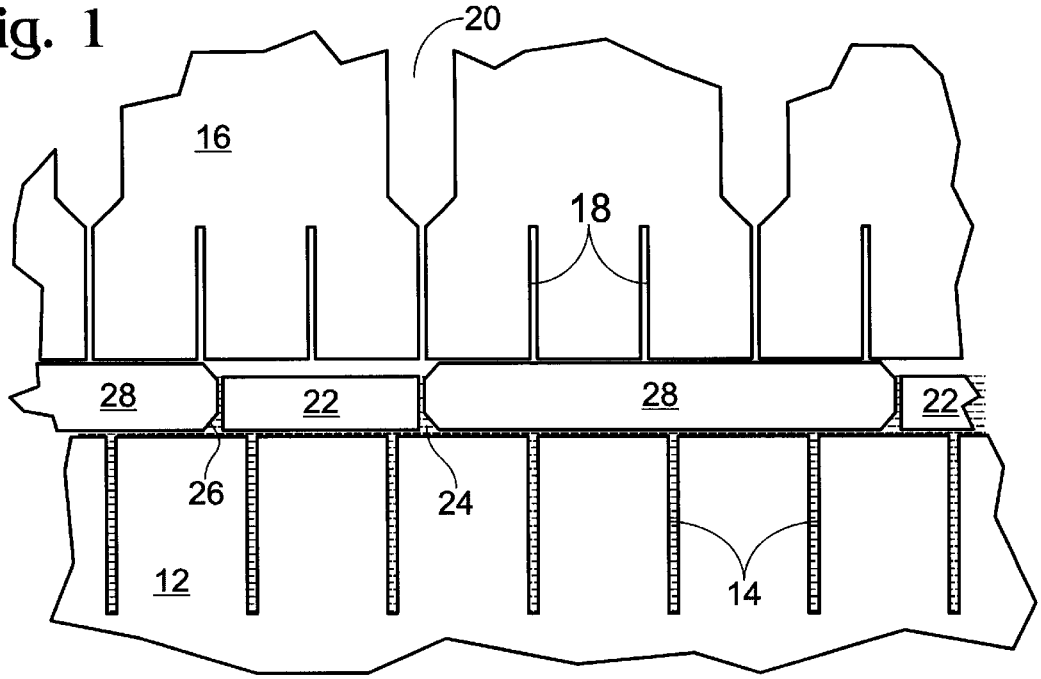
FIG. 1 is a partial side view of the lapping process during normal operation.

Turning now to FIG. 1, a lapping process utilizes a bottom plate 12 that contains a plurality of grooves 14 for transporting slurry (not shown). One or more carriers 22 are placed on, and is supported by, the bottom plate 12. Each carrier 22 contains at least one wafer-containing hole 24. The wafer-containing hole 24 is slightly larger in diameter that the wafer which will be placed therein, typically between 0.5 mm and 2 millimeters. The wafer containing holes 24 then have wafers 28 placed in them, with the wafers also being supported by the bottom plate 12. The wafers 28 have a beveled edge 26 that helps reduce mechanical fractures and chips on the edge of the wafer. The wafers 28 are also thicker than the carriers 22, such that the top and bottom surfaces of the wafers 28 can be removed by the lapping process, without having to lap the surface of the carriers 22. By providing carriers 22 that are thinner than the target thickness of the wafers 28 at the completion of the lapping cycle, the lapping cycle time can be reduced. A top plate 16 is then lowered onto the top surface of the wafers 28. The top plate 16 also contains a plurality of grooves 18 for transporting slurry. Slurry is fed into the grooves 18 through a series of slurry holes 20 that project through the top surface of the top plate 16 and connect with the grooves 18. Slurry is introduced into the lap cycle by providing slurry to the top of the slurry holes 20 and letting gravity and motion pull the slurry down through the slurry hole 20, into the grooves 18. The slurry then contacts the wafers 28, and is then carried out of the machine through the grooves 14. This slurry provides abrasives to assist in the removal of the wafer surfaces, and can also contain surfactants, cleaning agents, rust inhibitors and the like as required.

The top plate 16 is typically lowered onto the top surface of the wafers 28 by a pneumatic cylinder (not shown). At the start of the lap cycle, the top plate 16 is held against the surface of the wafers 28 under a low pressure controlled by the pneumatic cylinder. This is done to allow any rough anomalies on the surfaces of the wafers 28 to be gently lapped off, and to allow the process to develop momentum. After a prescribed time, the pressure exerted on the surface of the wafers 28 by the top plate 16 is gradually increased at a controlled rate by the pneumatic cylinder to help improve the lapping removal rate. Some lapping machines control the final amount of pressure exerted on the wafers 28, while others simply let the weight of the top plate 16 provide the pressure, whatever that may be. In any case, a significant increase in pressure is realized during lap cycle.

Figure 3:
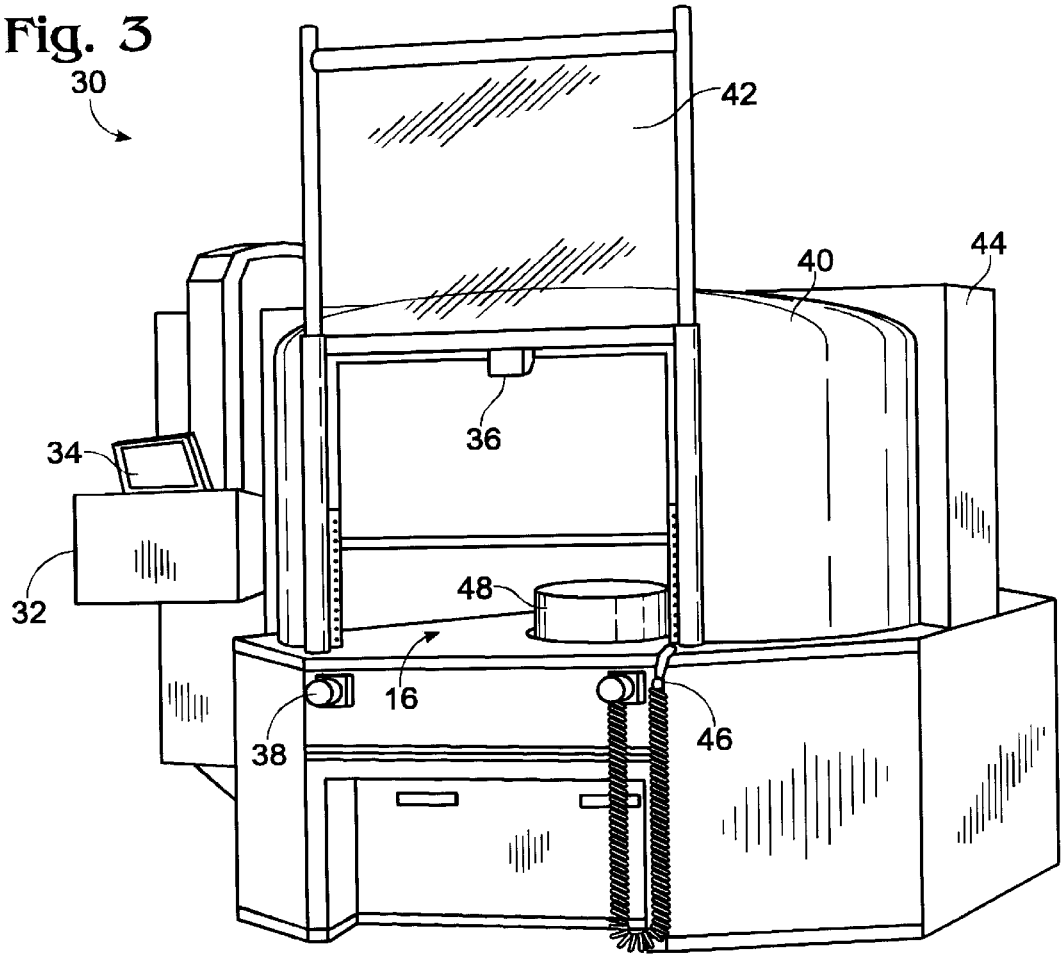
FIG. 3 is an orthographic view of a lapping machine containing the apparatus of the present invention.

Typically, the top plate 16 and the bottom plate 12 royate in opposite directions. The periphery of the carriers 22 contain gear teeth (not shown), and interact with a center gear 48 as shown in FIG. 3 and an annular gear (not shown). The center gear 48 drives the carriers 22 and causes them to remain in the proper position on the bottom plate 12, and to rotate around the center axis of the lap machine. The carriers 22 rotate around the center axis of the machine, and also rotate around the center of the carrier 22 itself. This rotation, combined with the spacing between the wafer 28 and the wafer-containing hole 24, allows the wafer to rotate freely within the carrier, and move across the surfaces of the top plate 16 and bottom plate 12 both radially and axially. This unrestricted movement results in a very flat workpiece with highly parallel surfaces.

Figure 2:
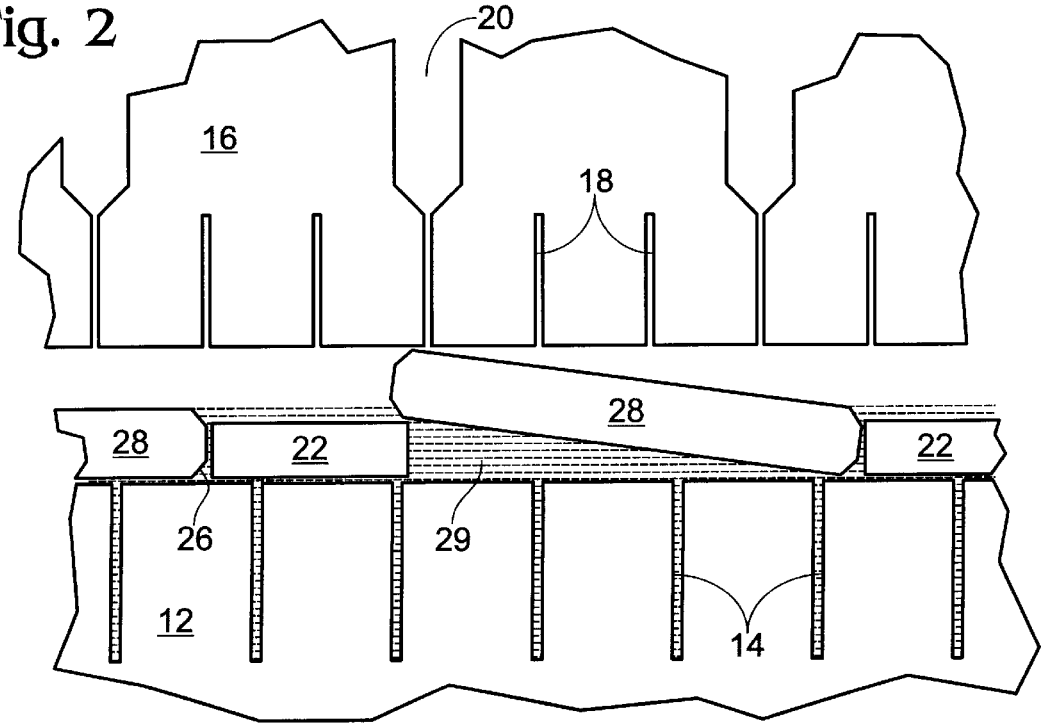
FIG. 2 is a partial side view of the lapping process wherein a wafer is not seated properly in the wafer-containing hole of the lapping carrier.

FIG. 2 demonstrates a situation wherein a wafer 28 is not properly seated in the wafer-containing hole 24. Improper seating can occur due to improper placement of the wafer 28 into the wafer-containing hole 24. Alternatively, during the start of a lap cycle when the pressure exerted on the wafers 28 by the top plate 16 is light, a wafer 28 can float out of the wafer-containing hole 24. This floating can be caused due to clogging of the slurry grooves 14 of the bottom plate 12. In such an instance, the slurry cannot flow in the grooves, and therefore causes a buildup of slurry between the bottom plate 12 and the wafer 28, illustrated as 29. In any case, when a wafer 28 is not seated properly in the wafer-containing hole 24, it gets trapped between the carrier 22 and the top plate 16. When this occurs, a distinct audible noise is generated, and the lap machine is stopped and the wafer 28 is seated into the wafer-containing hole 24.

Turning now to FIG. 3, a lap machine 30 contains a spray shield 40 that surrounds the lapping process. Access to the carriers 22 for placing and removing wafers 28 is provided through the shield door 42. When the shield door 42 is opened, access is provided to the carriers 22, plates 12 and 16, and wafers 28. However, the shield door 42 is electronically connected to a control panel 32, which prohibits commencement of the lap cycle when the shield door 42 is opened. Since the operator is shielded from the distinct audible noise generated when a wafer is not properly seated, a sound transmitter 36, such as a microphone, is placed within the confines of the spray shield 40. In one preferred embodiment, the sound transmitter 36 is mounted on a support beam 44 which is typically used for supporting the top plate 16 and the pneumatic cylinder used to raise and lower the top plate 16. In an alternative embodiment, the sound transmitter 36 can be placed on the center gear 48. In yet another embodiment, the sound transmitter 36 can be mounted on the inside of the spray shield 40. The sound generated by the commencement of the lapping process is transmitted from the sound transmitter 36 to a receiver 34. The receiver 34 can be located in any convenient place outside the confines of the spray shield 40, so long as the operator can hear the sound transmissions and can react accordingly in the event the distinct audible noise associated with a crash is detected. In the embodiment shown, the receiver 34 is located directly above the lap controller 32, but is in no way limited to this placement. In the event the distinct audible noise associated with a crash is detected, the operator can press one of the emergency stop buttons, designated 38. The wafer improperly seated can be reseated, and then the lap cycle restarted.

The sound transmitted through the sound transmitter 36 can optionally be enhanced through the use of amplifier (not shown). The amplifier can be used to boost the entire frequency range of sound produced by the lapping cycle, or can selectively be used to focus on specific frequency ranges associated with a crash. It is also conceivable and within the scope of the invention to electronically translate the signal processed in the amplifier, and provide the signal to the lap controller 32, thereby automatically stopping the lap cycle when the electronic signal associated with the noise generated during a crash is detected.

Although the disclosed invention herein specifically details detection of a wafer improperly seated in a carrier, it encompasses the use of sound to detect other lap problems such as a broken wafer, or a contaminant scratching the wafers, for example. As such, while several embodiments of the present invention have been shown and described, it is to be understood that many changes and modifications may be made thereunto without departing from the spirit and scope of the invention as defined in the appended claims.

What is claimed is:

1. A method for lapping semiconductor wafers comprising the steps of:

a) loading a plurality of semiconductor wafers into carriers controlled by a lapping machine;

b) lowering a top lapping plate onto said wafers;

c) starting said lapping machine; and d) transmitting sounds generated during the lapping process from a transmitter to a receiver, wherein said sounds indicate a crash.

2. The method of claim 1, wherein the transmitter is a microphone.

3. The method of claim 1, wherein the receiver is a speaker.

4. The method of claim 1, further comprising using an amplifier allow frequency ranges of the sounds to be selectively enhanced.

* * * * *